United States Patent [19]

Magnussen, Jr. et al.

[11] Patent Number: 4,757,899

[45] Date of Patent: Jul. 19, 1988

[54] CELL PACKAGING FOR FRUIT

[76] Inventors: Robert O. Magnussen, Jr., 620 S. Miller; Richard A. Magnussen, 1505 McKittrick, both of Wenatchee, Wash. 98801

[21] Appl. No.: 95,410

[22] Filed: Sep. 10, 1987

[51] Int. Cl.[4] ..... B65D 85/34

[52] U.S. Cl. ..... 206/493; 206/521.1; 206/521.9; 229/2.5 EC; 229/2.5 R; 426/106

[58] Field of Search ..... 206/493, 525, 521.1–521.3, 206/521.8, 521.9; 21150/55; 217/265; 220/4 B, 4 E; 229/2.5 EC, 2.5 R; 426/104, 106, 110, 124

[56] References Cited

U.S. PATENT DOCUMENTS

| | | | |
|---|---|---|---|
| 3,131,846 | 5/1964 | Whiteford | 229/2.5 EC |
| 3,171,562 | 3/1965 | Weiss | 217/26.5 |
| 3,365,308 | 1/1968 | Janicke | 217/26.5 |
| 3,529,531 | 9/1970 | Swett | 206/525 |
| 3,669,257 | 6/1972 | Janicke | 426/110 |
| 4,494,650 | 1/1985 | Cullen | 220/4 B |
| 4,556,147 | 12/1985 | Magnussen, Jr. | 206/493 |
| 4,605,127 | 8/1986 | Magnussen, Jr. | 206/525 |

FOREIGN PATENT DOCUMENTS 0004441 10/1979 European Pat. Off. ..... 229/2.5 EC

*Primary Examiner*—Jimmy G. Foster

*Attorney, Agent, or Firm*—William W. Haefliger

[57] ABSTRACT

Packaging for fresh fruit characterized as having a lower surface forming an upward, re-entrant recess, the packaging comprising (a) upper and lower container sections to receive the fruit, (b) first locating structure on one of the container sections to project into that recess, thereby to position the fruit, limiting its sideward movement relative to the container, (c) that one section having a wall engageable with another and like container during stacking of the containers, and that one section having a wall portion dished toward the interior of the container, that dished portion carrying said locating structure for flexing when the locating structure engages the fresh fruit.

14 Claims, 3 Drawing Sheets

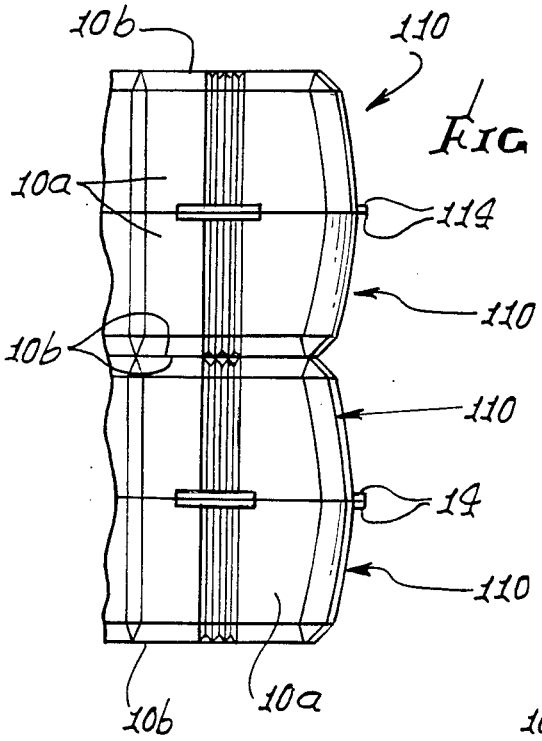
FIG. 4.
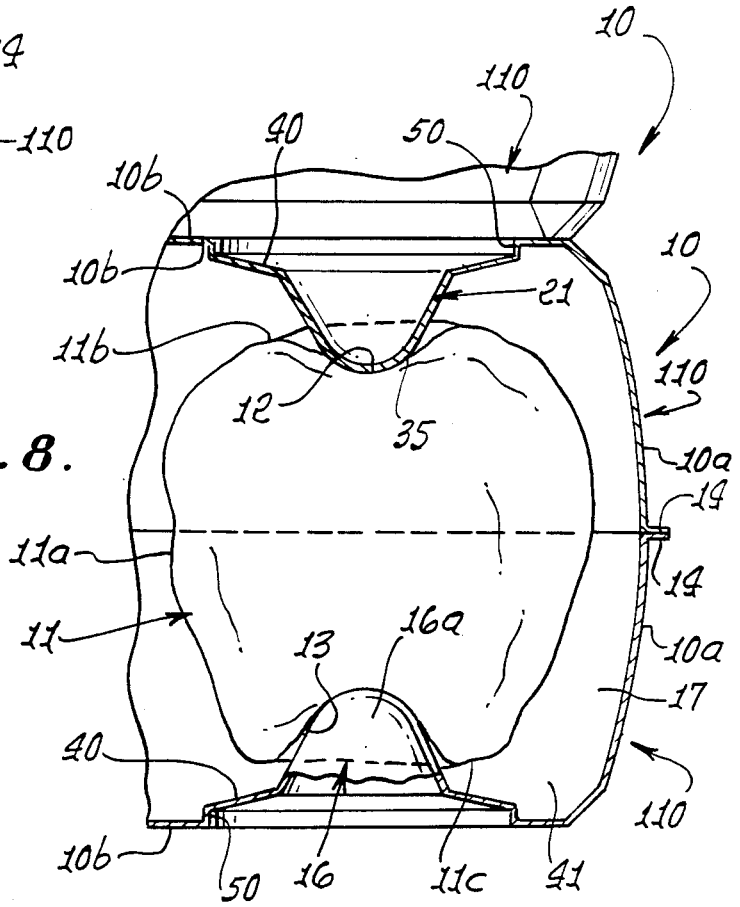
FIG. 8.
FIG. 7.
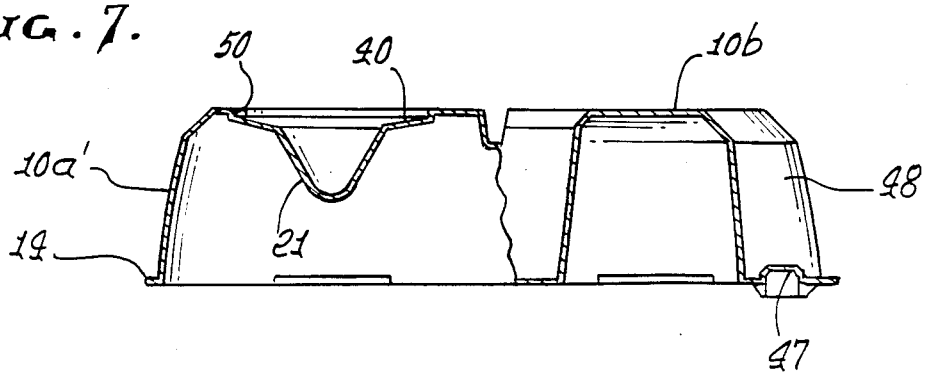

CELL PACKAGING FOR FRUIT

BACKGROUND OF THE INVENTION

This invention relates generally to packaging of fruit, and more particularly to a protective package for individual pieces of fruit, such as single apples.

The expense and handling of fruit, and especially prime apples, for example, creates a need for their protection, as during transport and other handling prior to reception by the consumer. Also, protective gift packaging or packaging for other purposes is frequently needed. My U.S. Pat. Nos. 4,605,127 and 4,556,147 disclose highly advantageous fruit packages; however, there is further need for packages that stack and that also accomodate and position fruit of different sizes and quantities.

SUMMARY OF THE INVENTION

It is a major object of the invention to provide a unique, attractive, efficient, inexpensive and stackable package for different sized individual pieces of fruit, such as apples, for example. Such fruit typically has one or more surfaces providing re-entrant recesses. Basically, the package of the invention comprises:

(a) upper and lower container sections to receive the fruit, (b) first locating means on one of the container sections to project into the recess, thereby to position the fruit, limiting its sideward movement relative to the container, (c) said one section having a generally horizontal wall engageable with another and like container during stacking of the containers, and said one section having a wall portion dished toward the interior of the container, that dished portion carried by said wall and carrying the locating means for flexing relative to said wall when the locating means engages the fresh fruit.

Typically, the dished wall portion is generally frusto conical and angled at between 5° and 15° relative to said horizontal wall, the dished wall portion peripherally connected to the horizontal wall; and second locating means may be carried on another and like container section, as on a dished, flexible wall portion thereof.

Also, the container sections may be sized to closely surround the fruit, in spaced relation thereto; the container sections being cup-shaped and having rim portions which are joined together; and fruit is positioned in the container sections by the first and second locating means in closely spaced relation to the container wall surrounding the fruit. The fruit may consist of an apple, and the container sections may consist of thin walled, molded synthetic resin.

It is a further object of the invention to provide each container section with multiple spaces to receive multiple pieces of fruit, each section having multiple, conically shaped locaters for the fruit pieces which may be of different sizes due to the individually flexible dished portion of the container wall. It is yet another object to provide a simple, effective fruit package which is stackable on like packages, and which accomodates pieces of fruit of different sizes.

These and other objects and advantages of the invention, as well as the details of an illustrative embodiment, will be more fully understood from the following specification and drawings, in which:

DRAWING DESCRIPTION

FIG. 4 is a fragmentary elevation showing stacking of packages incorporating the invention;

FIG. 7 is a side elevation on lines 7—7 of FIG. 5; and

FIG. 8 is a diagrammatic view of a cell of the package holding an apple.

DETAILED DESCRIPTION

Figure 1:
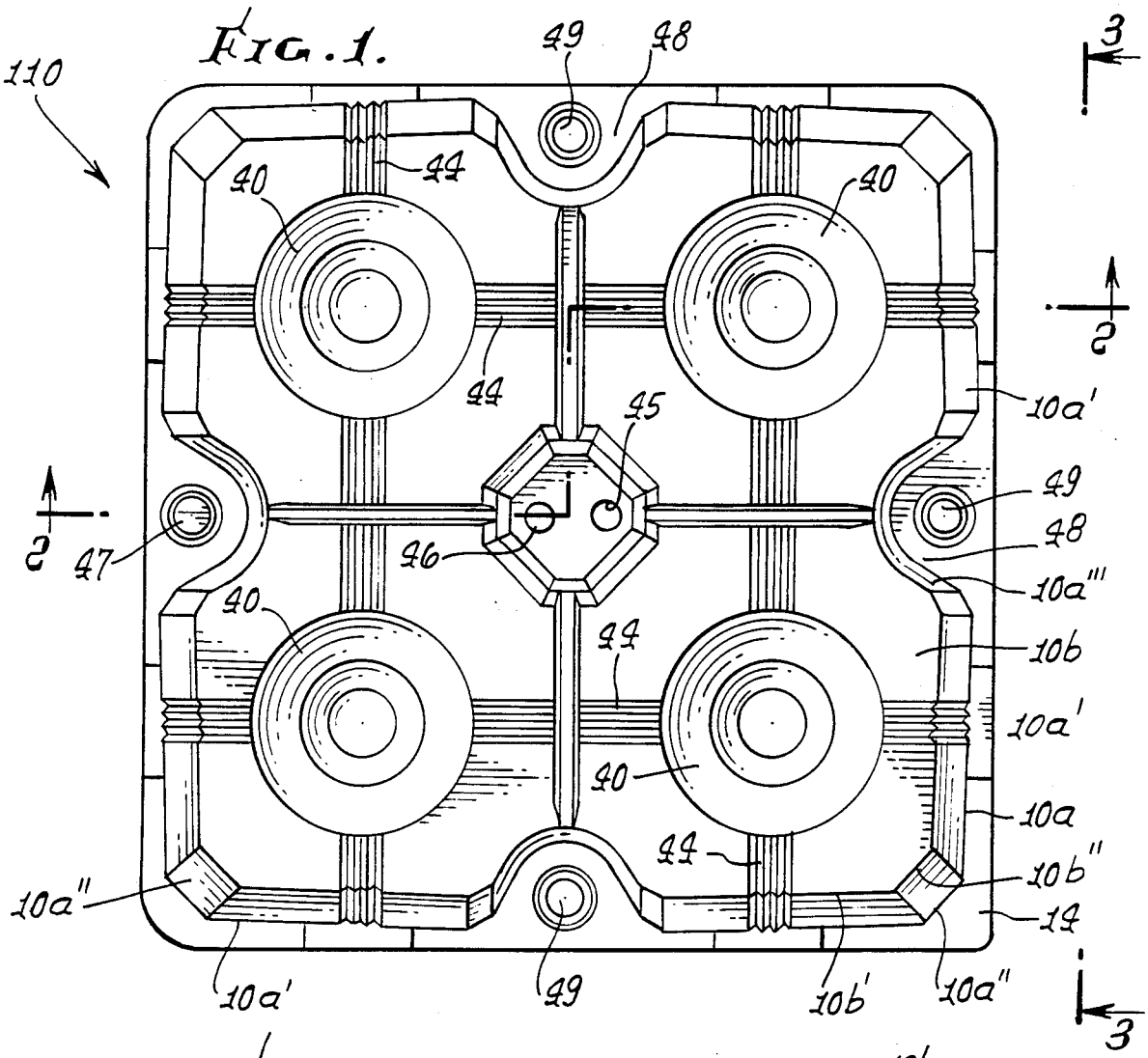
FIG. 1 is a top plan view showing a package incorporating the invention.

Stackable packages 10 shown in FIG. 8 are especially adapted in their construction for safe, protective encapsulation or retention of fresh fruit of different sizes, as for example apples 11. The apple shown has bulbous side surface 11*a*, and annularly upwardly convex top surface 11*b*, and an annularly downwardly convex bottom surface 11*c*. The top surface 11*b* forms a downwardly re-entrant, generally centrally recess 12; and the bottom surface 11*c* forms an upwardly re-entrant, generally central recess 13.

Each package 10 comprises a container or receptacle having like upper and lower sections 110, each having a thin side wall 10*a* and thin bottom wall 10*b*, and consists of molded synthetic resin such as polyethylene or polystyrene, for example. Side wall 10*a*, is shown as generally four-sided in FIG. 1, with curved sides indicated at 10*a'* and joined by beveled corner walls 10*a''*. All such walls taper to join the top and bottom walls 10*b* at chamfered elongated edges 10*b'*, and corners 10*b''*. The side walls 10*a* and corner walls 10*a''* turn outwardly at their rim extents to form peripheral flanges or rims 14 (see FIG. 4), which interfit in matching relation, and which are joined together as by suitable adhesive, heat sealing and/or snaps. A corner portion of each flange may project outwardly to be manually grasped for tear apart of the sections to gain access to the interior of the container. Note that the projections may extend in opposite directions, at opposite sides of the package, for grasping by both hands, to effect the container section separation.

In accordance with the invention, first locating means is provided on the container lower section to project upwardly into said recess, thereby to position the lower extent of the fruit, limiting its sideward movement relative to the container. Also, second locating means is provided on the container upper section to engage the upper extent of the fruit, thereby to position same limiting its sideward movement relative to the container.

As shown in the example, the first locating means may be molded integrally with bottom wall 10*b*, to comprise a part of that wall. It takes the form of a centrally located, generally conical projection 16 having a smoothly domed top surface 16*a* so as not to injure the apple when received relatively upwardly in apple bottom recess 13, to seat or support, and centrally locate the apple in spaced relation to the container side walls. See space 17 between the side of the apple and the container walls.

The second locating means is indicated generally at 21 as located between the top wall 10*b* and the top surface 11*b* of the apple, and characterized as protectively retaining the apple in position, vertically, relative to and spaced from the container side walls 10*a* and the top wall 10*b*. For this purpose, the locating means 21 may be generally conical having a smoothly domed lower surface 35 and it may center the top of the apple in the container upper section. Walls 10*b* may be slightly deflected, i.e. tensioned, to hold the apple in position.

As is clear, the apple is completely protected by the described package, and only the re-entrant surfaces of the apple are engaged, but in a protective manner. The package may be transported, with force applciation to it, without injuring the apple, since the apple is spaced from the container side walls, and resiliently suspended between and spaced from the annular top and bottom walls 10*b*. In use, the container sections are easily pulled apart to drop out the apple.

Figure 5:
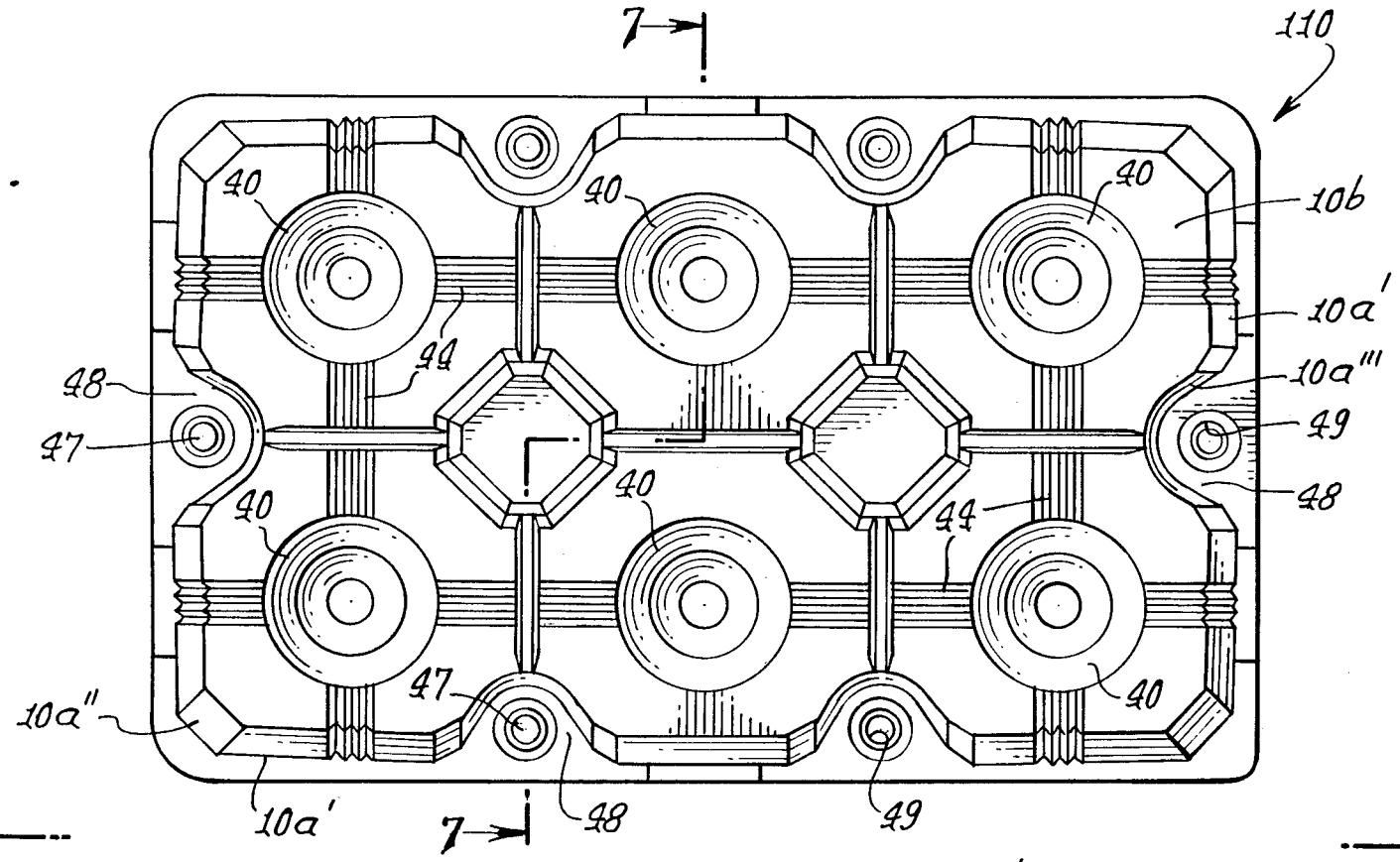
FIG. 5 is a view like FIG. 1 showing a modification.
Figure 6:
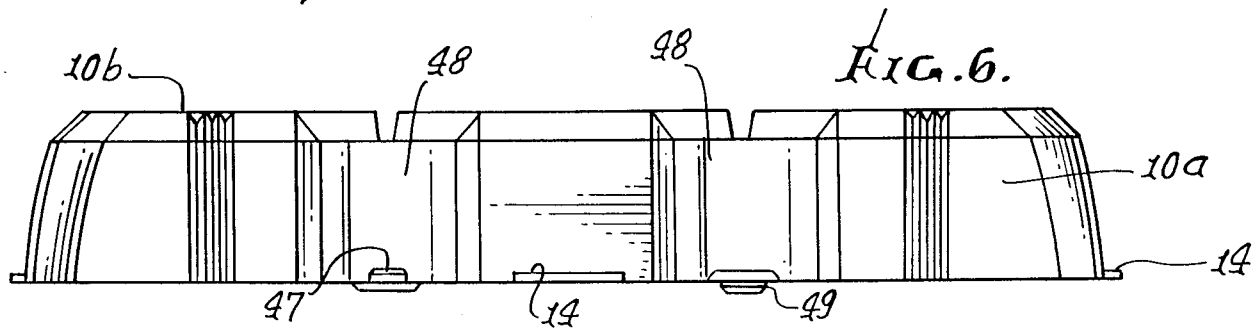
FIG. 6 is an end elevation on lines 6—6 of FIG. 5.

In accordance with an important feature of the invention, the container section generally horizontal walls 10*b* are engageable with like container walls, during stacking, as is clear from FIGS. 4 and 8. At the same time, fruit such as apples of different sizes are accomodated by the container, without disturbing the walls 10*b* and their engagement with other container walls 10*b*. This unusually beneficial result is effected by providing at least one of the two sections 110, and preferably both sections 110 are provided, with wall portions 40 that are dished (i.e. shallowly tapered, frusto-conically) toward the container interior 41, the dished portion 40 or portions carrying one or both of the conical or domed locating means 16 and 21. the construction is such that if a larger apple is received between 16 and 21, the dished wall portion or portions 40 will yieldably flex toward the plane of wall or walls 10*b*, while firmly retaining the apple or fruit located between humps or domes 16*a* and 35. This is further accomodated and aided by the localized resiliently expansible bellows (i.e. corrugated) construction of the walls 10*b* at regions 44, there being four such regions extending away from each dished wall portion at 12, 3, 6, and 9 o'clock orientations, as seen in FIG. 1. In this regard, FIG. 1 shows a four cell structure, adapted to receive four apples; and FIG. 5 shows a six cell structure adapted to receive six apples. A unitary cell to carry only one apple is also contemplated. Regions 44 also extend down the side walls as is clear from FIGS. 1, 3, 5, 6 and 7.

.The angularity of the dished wall portion is between 5° and 15° relative to the horizontal plane of wall 10*b*, the dished portion being circularly peripherally connected to wall 10*b*, as via an annular frusto-conical connecting wall 50, whereby the dished portion 40 is inwardly offset to allow over-center flexing if necessary to accomodate a large apple. The dished wall angularity is preferably about 10°, for best results.

Figure 2:
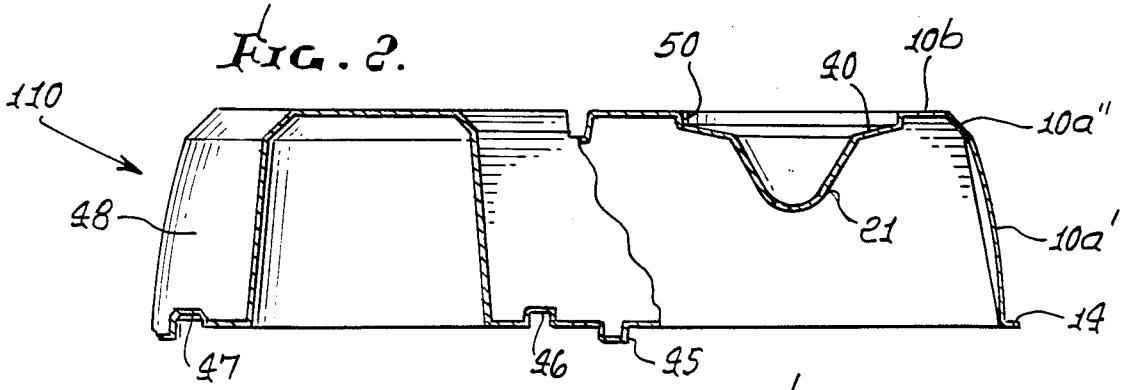
FIG. 2 is a section on lines 2—2 of FIG. 1.
Figure 3:
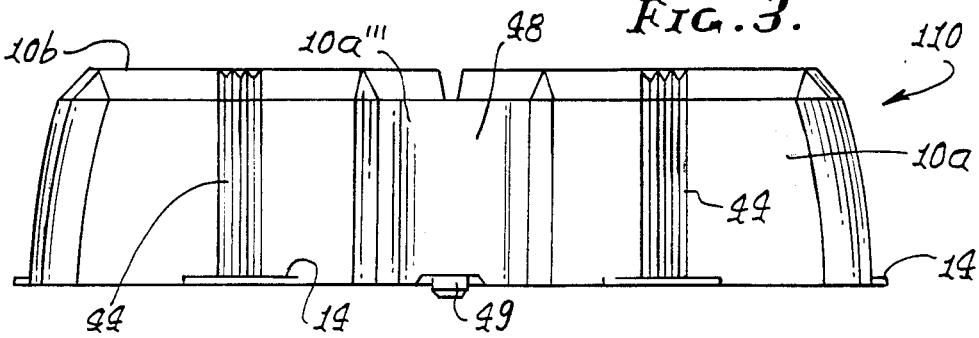
FIG. 3 is a side elevation on lines 3—3 of FIG. 1.

FIGS. 1 and 2 also show tongue and groove parts 45 and 46 centrally carried by the wall 10*b*, and adapted to interfit with corresponding groove and tongue parts on the horizontal wall of an adjacently vertically stacked package. Also, the side walls 10*a'* are inwardly deflected at medial location 10*a'''*, to define side pockets 48 opening outwardly. Similar tongue and groove parts 47 and 48 are provided at the pocket bottom walls 14' for interfitting groove and tongue parts on pocket walls of adjacent sections, for aligning the sections, and holding them together, frictionally in case the flanges or rims 14 are not heat sealed together.

We claim:

1. In a package for fresh fruit characterized as having a lower surface forming an upward, re-entrant recess, the combination comprising:

(a) upper and lower container sections to receive said fruit, (b) first locating means on one of the container sections to project into said recess, thereby to position the fruit, limiting its sideward movement relative to the container, (c) said one section having a generally horizontal wall engageable with another and like container during stacking of the containers, and said one section having a wall portion dished toward the interior of the container, said dished portion carried by said wall and carrying said locating means for flexing relative to said wall when the locating means engages the fresh fruit, (d) said dished wall portion angled at between 5° and 15° relative to said horizontal wall, and there being an annular, near vertical connecting wall merging at one end thereof with said horizontal wall, and merging at the opposite end thereof with the peripheral extent of said dished wall portion, the vertical dimension of said connecting wall being substantially less than the slant height dimenson of said dished wall portion, the dished wall portion thereby everywhere spaced from the plane of said horizontal wall.

2. The combination of claim 1 wherein the dished wall portion is generally frusto conical and angled at about 10° relative to said horizontal wall.

3. The combination of claim 1 including second locating means on the container other section to engage the fruit, thereby to position same limiting its sideward movement relative to the container, said other section having a horizonta wall engageable with another and like container during said stacking, said other section having a wall portion dished toward the interior of the container, said dished wall portion carried by said horizontal wall and carrying said locating means for flexing relative to said wall when the locating means engages the fresh fruit, and there being another annular near vertical connecting wall merging at one end thereof with said horizontal wall, and merging at the opposite end thereof with the peripheral extent of said dished wall portion, the vertical dimension of said connecting wall being substantially less then the slant height dimension of said dished wall portion, the dished wall portion thereby everywhere spaced from the plane of said horizontal wall.

4. The combination of claim 1 wherein said container sections are sized to closely surround said fruit, in spaced relation thereto.

5. The combination of one of claims 1, 2 and 3 wherein said container sections consists of molded synthetic resin.

6. The combination of one of claims 1, 2 and 3 wherein said container sections are cup-shaped, the upper section inverted relative-to the lower section, the two sections having rim portions which are joined together.

7. The combination of claim 3 including said fruit in the container sections and positioned therein by said first and second locating means.

8. The combination of claim 7 wherein said fruit consists of an apple.

9. The combination of one of claims 1, 2, and 3 wherein said container sections are sized to define only one interior space sized to receive the fresh fruit.

10. The combination of one of claims 1, 2 and 3 wherein said container sections are sized to defined multiple interior spaces sized to receive multiple pieces of fresh fruit, there being a number of said dished wall portions, at least one for each of said spaces.

11. The combination of claim 1 wherein said horizontal wall has localized bellows regions extending toward said dished wall portion.

12. The combination of claim 11 wherein said localized bellows regions are located at about 90° intervals about the dished wall portion.

13. The combination of claim 1 including tongue and groove parts on the horizontal wall of an adjacent vertically stacked package.

14. The combination of claim 1 wherein the sections have side walls that are inwardly deflected to form side pockets, the rims at and within said side pockets defining vertical guide openings, for tongues on adjacent section structure.

* * * * *